US010408097B2

(12) United States Patent
Nakamura et al.

(10) Patent No.: US 10,408,097 B2
(45) Date of Patent: Sep. 10, 2019

(54) FOUR-CYCLE OHV ENGINE

(71) Applicant: SUZUKI MOTOR CORPORATION, Hamamatsu-Shi, Shizuoka (JP)

(72) Inventors: Hideto Nakamura, Hamamatsu (JP); Yasuomi Ishihara, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 261 days.

(21) Appl. No.: 15/291,158

(22) Filed: Oct. 12, 2016

(65) Prior Publication Data

US 2017/0107874 A1 Apr. 20, 2017

(30) Foreign Application Priority Data

Oct. 20, 2015 (JP) ..... 2015-206703

(51) Int. Cl.

| | |
|---|---|
| ***F01M 11/03*** | (2006.01) |
| ***F01M 1/02*** | (2006.01) |
| ***F01M 1/10*** | (2006.01) |
| ***F01M 11/02*** | (2006.01) |
| ***F02M 35/10*** | (2006.01) |
| ***F02B 75/02*** | (2006.01) |

(Continued)

(52) U.S. Cl.

CPC ..... *F01M 11/03* (2013.01); *F01L 1/047* (2013.01); *F01M 1/02* (2013.01); *F01M 1/10* (2013.01); *F01M 1/16* (2013.01); *F01M 11/0004* (2013.01); *F01M 11/02* (2013.01); *F02B 61/045* (2013.01); *F02B 75/007* (2013.01); *F02B 75/02* (2013.01); *F02M 35/1015* (2013.01); *F01L 1/146* (2013.01); *F01L 2001/0475* (2013.01); *F01L 2001/0476* (2013.01); *F01L 2250/06* (2013.01); *F01L 2810/02* (2013.01); *F01M 2001/0261* (2013.01); *F01M 2001/062* (2013.01); *F01M 2001/064* (2013.01); *F01M 2011/026* (2013.01); *F02B 2075/027* (2013.01)

(58) Field of Classification Search

CPC .. F01M 1/02; F01M 1/10; F01M 1/16; F01M 11/02; F01M 11/03; F01M 11/0004; F01M 2001/062; F01M 2001/0261; F01M 2001/064; F01M 2011/026; F02B 75/02; F02B 75/007; F02B 61/045; F02B 2075/027; F02M 35/1015; F01L 1/047; F01L 1/146; F01L 2810/02; F01L 2250/06; F01L 2001/0476; F01L 2001/0475

See application file for complete search history.

(56) References Cited

U.S. PATENT DOCUMENTS 5,090,375 A * 2/1992 Hudson ..... F01M 1/02 123/196 R
5,456,230 A * 10/1995 VanRens ..... F01M 1/04 123/196 W (Continued)

FOREIGN PATENT DOCUMENTS

JP 10-47030 A 2/1998

*Primary Examiner* — Grant Moubry
(74) *Attorney, Agent, or Firm* — Troutman Sanders LLP

(57) ABSTRACT

The oil filter device is disposed on a side portion of one side of a cylinder body in a width direction in a cylinder head side with respect to an engine case in a space between center lines of main lubricating oil passages and a cylinder axis line of the cylinder body, and includes an oil pump disposed on the engine case and further lubricating oil passages that connect to the main lubricating oil passage.

3 Claims, 7 Drawing Sheets

(51) Int. Cl.

| | |
|---|---|
| ***F01L 1/047*** | (2006.01) |
| ***F01M 11/00*** | (2006.01) |
| ***F02B 75/00*** | (2006.01) |
| ***F02B 61/04*** | (2006.01) |
| ***F01M 1/16*** | (2006.01) |
| *F01L 1/14* | (2006.01) |
| *F01M 1/06* | (2006.01) |

(56) References Cited

U.S. PATENT DOCUMENTS 5,524,581 A * 6/1996 Rush, II ..... F01M 1/02 123/196 M
5,967,112 A * 10/1999 Haga ..... F01M 5/002 123/196 AB
6,113,442 A * 9/2000 Nakamura ..... F01M 1/20 440/1
6,401,682 B1 * 6/2002 Nozue ..... F01M 1/02 123/195 P
6,422,194 B2 * 7/2002 Ito ..... F01M 1/04 123/196 R
6,460,504 B1 * 10/2002 Phillips ..... F01M 1/06 123/195 P
6,564,905 B1 * 5/2003 Yukioka ..... F01M 1/02 123/192.2
6,742,491 B1 * 6/2004 Ghelfi ..... F04C 2/00 123/196 R
6,807,936 B1 * 10/2004 Burger ..... F01M 1/16 123/196 R
6,935,293 B2 * 8/2005 Bonde ..... F01M 1/00 123/90.33
7,201,132 B2 * 4/2007 Miyake ..... F01M 1/04 123/195 HC
7,210,436 B2 * 5/2007 Oberleitner ..... A01D 69/00 123/90.27
8,376,795 B2 * 2/2013 Tawa ..... F01M 11/02 440/88 L

* cited by examiner

SEC I - I

FOUR-CYCLE OHV ENGINE

CROSS-REFERENCE TO RELATED APPLICATIONS

This application is based upon and claims the benefit of priority of the prior Japanese Patent Application No. 2015-206703, filed on Oct. 20, 2015, the entire contents of which are incorporated herein by reference.

BACKGROUND OF THE INVENTION

Field of the Invention

The present invention relates to a four-cycle OHV engine appropriate for such as an outboard motor that includes an internal combustion engine as a power source.

Description of the Related Art

In what is called a vertical engine where a crankshaft is vertically disposed, a lubricating system including an oil pump to pump lubricating oil includes a lubricating oil passage to circulate the lubricating oil. The lubricating system includes an oil filter, a drive mechanism of an oil pump and similar unit, and these units are connected to one another via a lubricating oil passage.

For example, in an engine disclosed in Patent Document 1, a main shaft of an oil pump extends upward to be integrally rotatingly coupled to a lower end of a balancer shaft. This causes the oil pump to be directly driven when the balancer shaft rotates. Thus the oil pump is driven by the balancer shaft other than a camshaft, includes an oil filter on a cylinder side portion, and uses the oil filter to return cleaned lubricating oil after filtration to a crankshaft.

Patent Document 1: Japanese Laid-open Patent Publication No. 10-47030

In the conventional vertical engine, the lubricating oil passage that supplies the lubricating oil after the filtration by the oil filter is not directly connected to the drive shaft of the oil pump. This makes the lubricating oil passage complicated. The lubricating oil passage for the camshaft is additionally required, and this makes the size of the engine large especially in the width direction. Accordingly, it has been an actual condition that such as downsizing of the engine is actually difficult.

SUMMARY OF THE INVENTION

The present invention has been made in view of the above-described problems, and it is an object of the present invention to provide a four-cycle OHV engine that effectively ensures a downsizing of an engine, a workability improvement of a lubricating oil passage, and similar improvement.

A four-cycle OHV engine of the present invention includes a crankshaft disposed in a vertical direction, an engine case housing and supporting the crankshaft, and a camshaft disposed parallel to the crankshaft in the engine case. A cylinder axis line of the four-cycle OHV engine is perpendicular to the vertical direction. The engine case includes bearings that rotatably support the crankshaft and the camshaft, an oil pump and lubricating oil passages that pump lubricating oil to the bearings, and an oil filter device that keeps the lubricating oil clean. The lubricating oil passages include main lubricating oil passages. The main lubricating oil passages include communication portions linearly formed with extending portions. The communication portions communicate between the respective bearings of the crankshaft and the camshaft from outside the engine case. The extending portions extend from outside the engine case to the bearing of the camshaft. The oil filter device is disposed on a side portion of one side of a cylinder body in a width direction in a cylinder head side with respect to the engine case in a space between a center line of the main lubricating oil passage and the cylinder axis line of the cylinder body, and the oil filter device includes an oil pump disposed on the engine case and further lubricating oil passages that connect to the main lubricating oil passage.

In the four-cycle OHV engine of the present invention, the camshaft is disposed biased to the cylinder head side with respect to the crankshaft, and the oil pump is disposed on a lower engine case of the engine case corresponding to a shaft end portion of the camshaft. The main lubricating oil passages include outer portions inclining to a direction of the cylinder head such that the main lubricating oil passages intersect with the cylinder axis line with an acute angle.

In the four-cycle OHV engine of the present invention, the oil filter device includes a cylindrically-shaped filter and a filter case that houses the filter. The filter case is disposed such that a central axis line of the cylindrical shape of the filter is parallel to an axis line of the crankshaft, and the filter case includes an opening configured to mount and remove the filter and a lid body that covers the opening.

In the four-cycle OHV engine of the present invention, the engine has the cylinder axis line configured to be parallel with respect to a travelling direction of an outboard motor that includes the engine. An intake device that supplies engine combustion air is disposed on one side portion of the cylinder body on an opposite side to the oil filter device across the cylinder axis line.

DETAILED DESCRIPTION OF THE PREFERRED EMBODIMENTS

The following describes preferred embodiments of a four-cycle OHV engine according to the present invention based on the drawings.

Figure 1:
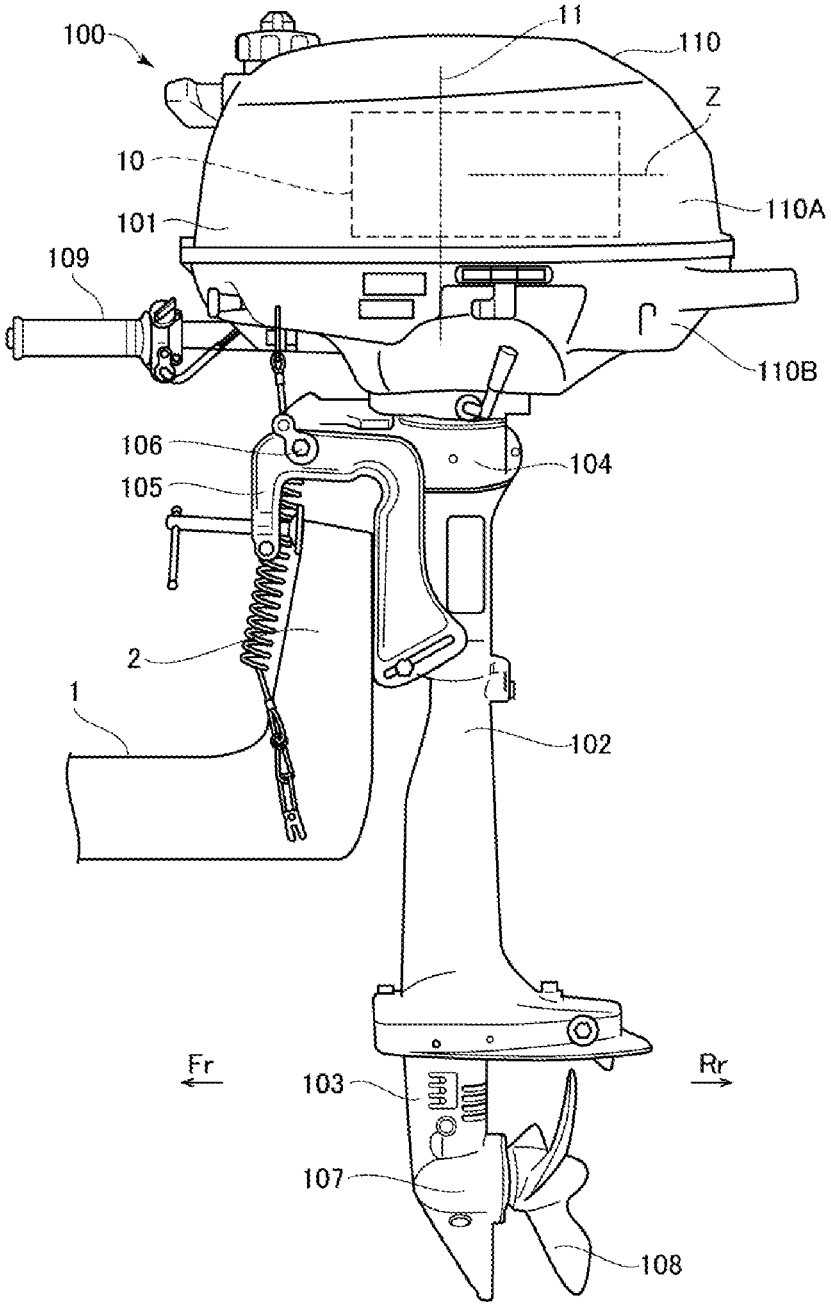
FIG. 1 is a left side view illustrating an exemplary schematic configuration of an outboard motor according to the present invention.

FIG. 1 is a left side view illustrating an exemplary schematic configuration of an outboard motor 100 as an application example of the present invention. In this example, as illustrated in FIG. 1, the outboard motor 100 is secured to a rear plate 2 of a ship 1 on a front portion side of the outboard motor 100. The outboard motor 100 mounts an engine 10 according to the present invention. In the following description, in each drawing, an arrow Fr and an arrow Rr indicate forward and rearward of the outboard motor 100 or the engine 10 respectively, and an arrow R and an arrow L indicate the right side and the left side of the side portion of the outboard motor 100 respectively, as necessary.

In an overall configuration of the outboard motor 100, an upper unit (or power unit) 101, a middle unit 102 and a lower unit 103 are configured to be located from an upper portion to a lower portion in the order. The outboard motor 100 includes the engine 10 in the upper unit 101 so as to vertically mount to support the engine 10 such that a crankshaft 11 of the engine 10 is arranged in a vertical direction as described below. For the engine 10, a single cylinder engine is typically applicable. The middle unit 102 is horizontally turnably supported around a support shaft disposed on a swivel bracket 104. The swivel bracket 104 includes a pair of clamp brackets 105 (suspension device) on both right and left sides, and both clamp brackets 105 are coupled to one another via a tilt shaft 106 disposed in a lateral direction. The clamp brackets 105 are secured to the rear plate 2 of the ship 1, and the entire outboard motor 100 is supported rotatably in the vertical direction around the tilt shaft 106 via the swivel bracket 104.

The middle unit 102, more specifically a drive shaft housing, includes a drive shaft penetratingly disposed in the vertical direction to be coupled to a lower end portion of the crankshaft 11. A driving force of the drive shaft is transmitted to a propeller shaft in a gear case 107 of the lower unit 103. The propeller shaft mounts a propeller 108 on a rear end, and the power of the engine 10 is configured to be finally transmitted to the propeller 108 through a power transmission path constituted of the crankshaft, the drive shaft, the propeller shaft, and similar component to rotatably drive the propeller 108. A steering wheel 109 (steering gear) is configured to be appropriately turned to steer the propeller 108 in a desired angle.

In the above-described case, the upper unit 101 is covered with an exterior cover 110. The exterior cover 110 includes an upper cover 110A that covers the upper portion of the upper unit 101, and a lower cover 110B that covers the lower portion of the upper unit 101. The upper cover 110A and the lower cover 110B are integrally joined together to form an appearance form of the exterior cover 110 in such as an approximately egg shape or lemon shape as a whole.

Figure 2:
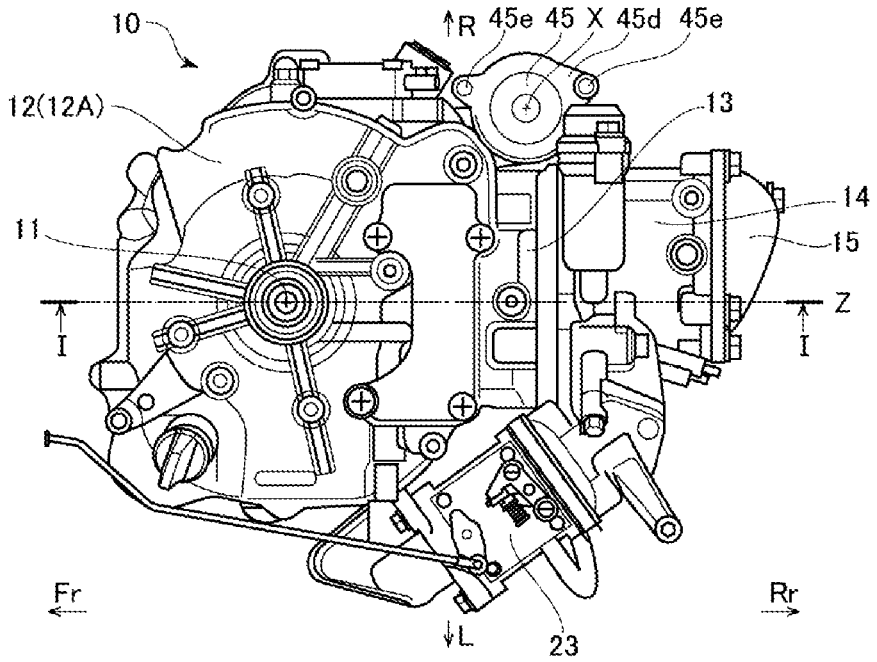
FIG. 2 is a top view illustrating an engine according to an embodiment of the present invention.
Figure 3:
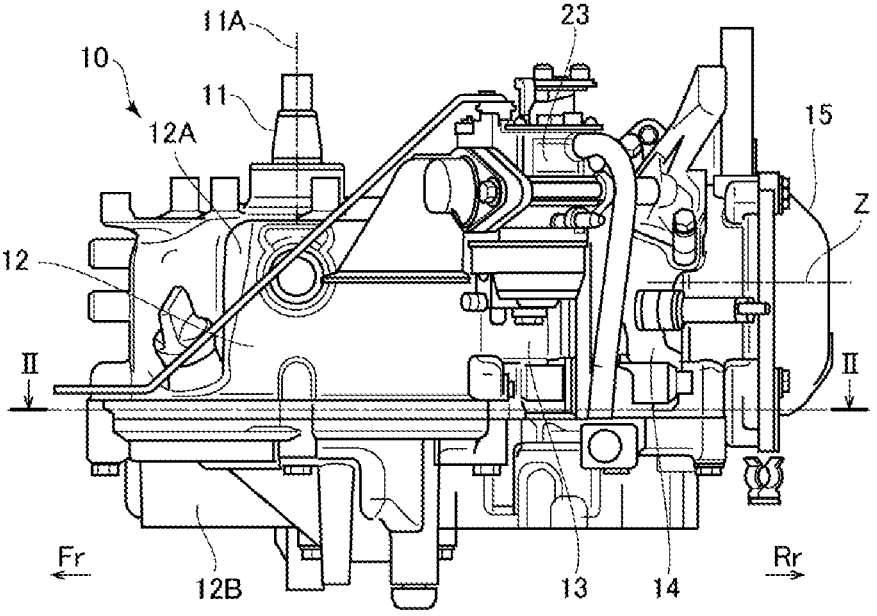
FIG. 3 is a side view illustrating the engine according to the embodiment of the present invention.

Next, a description will be given of the engine 10 according to the present invention. FIG. 2 is a top view illustrating the engine 10, and FIG. 3 is a side view illustrating the engine 10 according to the embodiment. In this example, an OHV (Over Head Valve) engine is employed as the engine 10, and the engine 10 is vertically mounted and supported in the upper unit 101 via an engine holder such that the crankshaft 11 of the engine 10 is arranged in the vertical direction. As illustrated in such as FIG. 2, the engine 10 includes an engine case 12, a cylinder block 13 (cylinder body), a cylinder head 14, and a cylinder head cover 15. The cylinder block 13, the cylinder head 14 and the cylinder head cover 15 are integrally joined in the order on the back of the engine case 12. When the outboard motor 100 is equipped to the ship 1 as illustrated in FIG. 1, a cylinder axis line Z typically orients rearward in a horizontal direction perpendicular to the vertical direction as illustrated in FIG. 2 and FIG. 3. In this case, the cylinder axis line Z is configured to be parallel with respect to a travelling direction (the forward arrow Fr in FIG. 1) of the outboard motor 100 that includes the engine 10.

Figure 4:
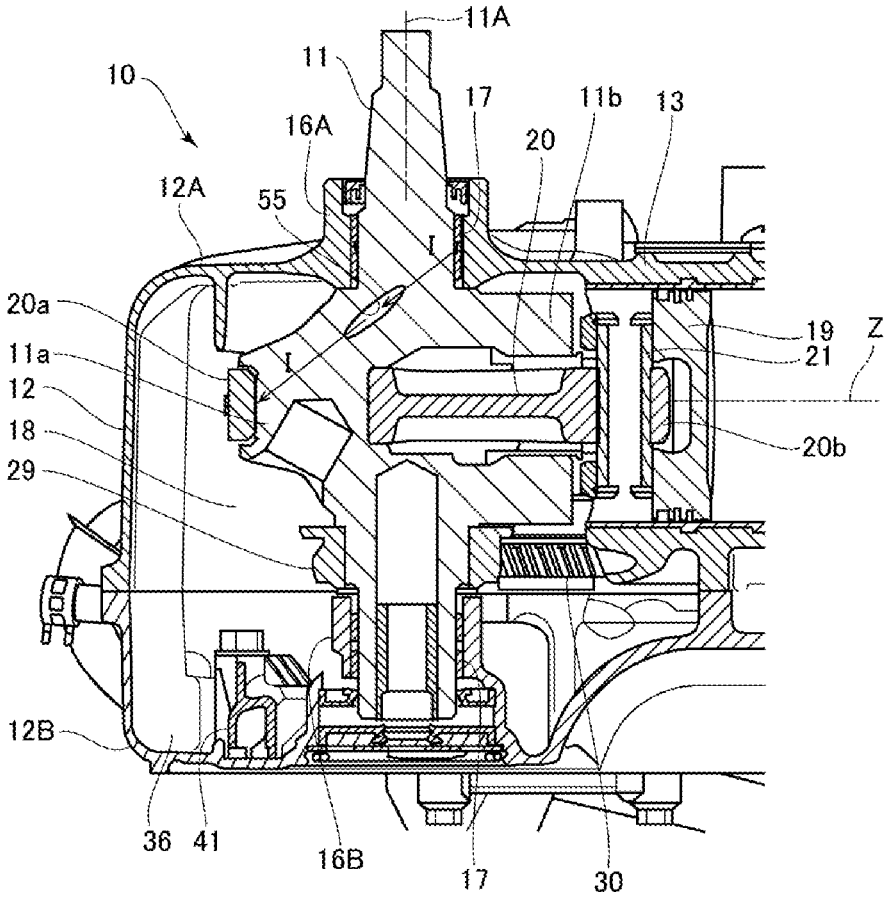
FIG. 4 is a cross-sectional view taken along a line I-I in FIG. 2.

The engine case 12 is divided into an upper engine case 12A and a lower engine case 12B each of which integrally includes the cylinder block 13. As illustrated in FIG. 4, the crankshaft 11 is rotatably supported in a crank chamber 18 by bearings 16A and 16B respectively disposed in the upper engine case 12A and the lower engine case 12B. The bearings 16A and 16B mount such as sliding bearings 17. The cylinder block 13 includes a cylinder bore that houses a piston 19 reciprocatably along a direction of the cylinder axis line Z. Further referring to FIG. 5, the crankshaft 11 and the piston 19 are coupled to one another via a connecting rod 20. The connecting rod 20 includes a large end portion 20*a* coupled to a crankpin 11*a* of the crankshaft 11, and a small end portion 20*b* coupled to a piston pin 21 of the piston 19. The reciprocation of the piston 19 in the direction of the cylinder axis line Z in the cylinder bore of the cylinder block 13 rotatably drives the crankshaft 11 via the connecting rod 20. On the crankshaft 11, a crank web 11*b* that integrally rotates with the crankshaft 11 is attached.

The cylinder head 14 includes a combustion chamber (not illustrated in detail) with which an intake port 22 (the position is abbreviated in FIG. 5) and an exhaust port are each communicated. As illustrated in FIG. 2 and FIG. 3, an intake device 23 with a throttle body is connected to the intake port 22, and air-fuel mixture is supplied to the combustion chamber from the intake device 23 via the intake port 22. In this example, the intake device 23 is arranged on the left side portion of the cylinder block 13. The exhaust port is connected to an exhaust pipe, and exhausts combustion gas generated in the combustion chamber as exhaust gas through an exhaust pipe.

Figure 5:
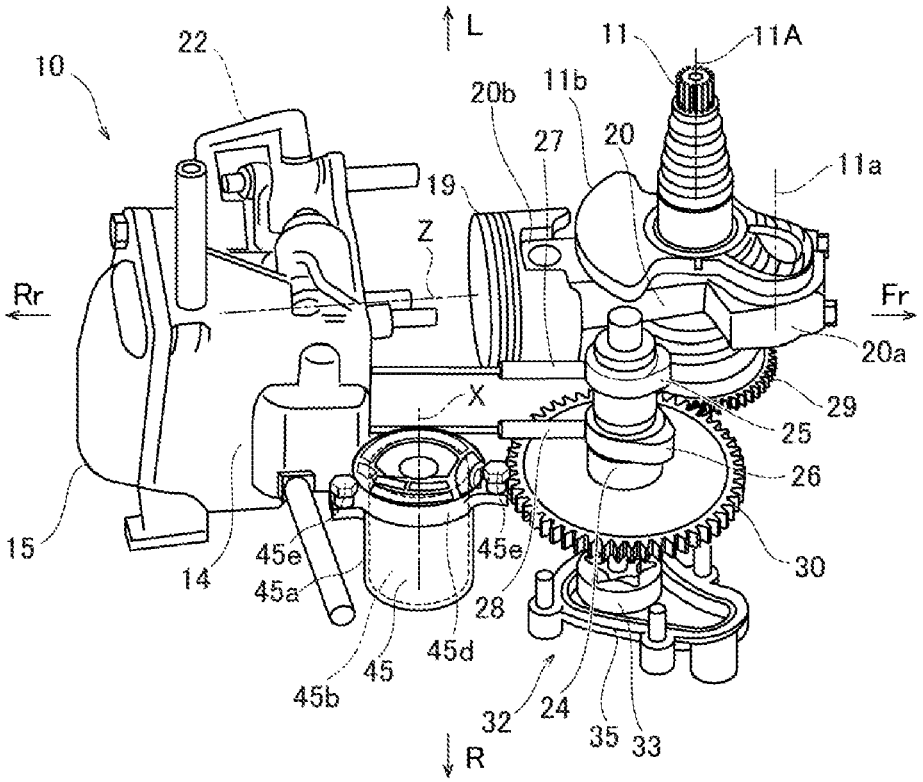
FIG. 5 is a perspective view illustrating an exemplary main configuration of the engine according to the embodiment of the present invention.

An intake valve and an exhaust valve open and close between the combustion chamber, and the intake port 22 and the exhaust port respectively at a predetermined timing. That is, the intake valve and the exhaust valve cause the combustion chamber to be communicated with the intake port 22 and the exhaust port, or obstruct between the combustion chamber, and the intake port 22 and the exhaust port. The engine 10 includes a valve mechanism that drives to open and close the intake valve and the exhaust valve, and as illustrated in FIG. 5, the engine 10 of the embodiment includes a camshaft 24 that drives the valve mechanism adjacent to the right side of the crankshaft 11. The camshaft 24 is rotatably supported on the engine case 12 parallel to the crankshaft 11, that is, so as to orient the vertical direction. In the valve mechanism, the cylinder head 14 includes a rocker shaft (not illustrated in detail) to which an intake-side rocker arm and an exhaust-side rocker arm are swingably journaled. The intake-side rocker arm and the exhaust-side rocker arm are coupled to the camshaft 24 via an intake-side cam 25 and an exhaust-side cam 26, which are disposed on the camshaft 24, and an intake-side push rod 27 and an exhaust-side push rod 28, which are driven by the intake-side cam 25 and the exhaust-side cam 26. On the crankshaft 11 and the camshaft 24, a drive gear 29 and a driven gear 30 are mounted so as to engage with one another. The camshaft 24 is rotatably driven by the driving force of the crankshaft 11 with a predetermined reduction gear ratio (1/2 in this example). The rotation of the camshaft 24 synchronizes the intake valve and the exhaust valve with the crankshaft 11 via the above-described cam/push rod coupling to open and close the intake valve and the exhaust valve at a predetermined timing.

Figure 6:
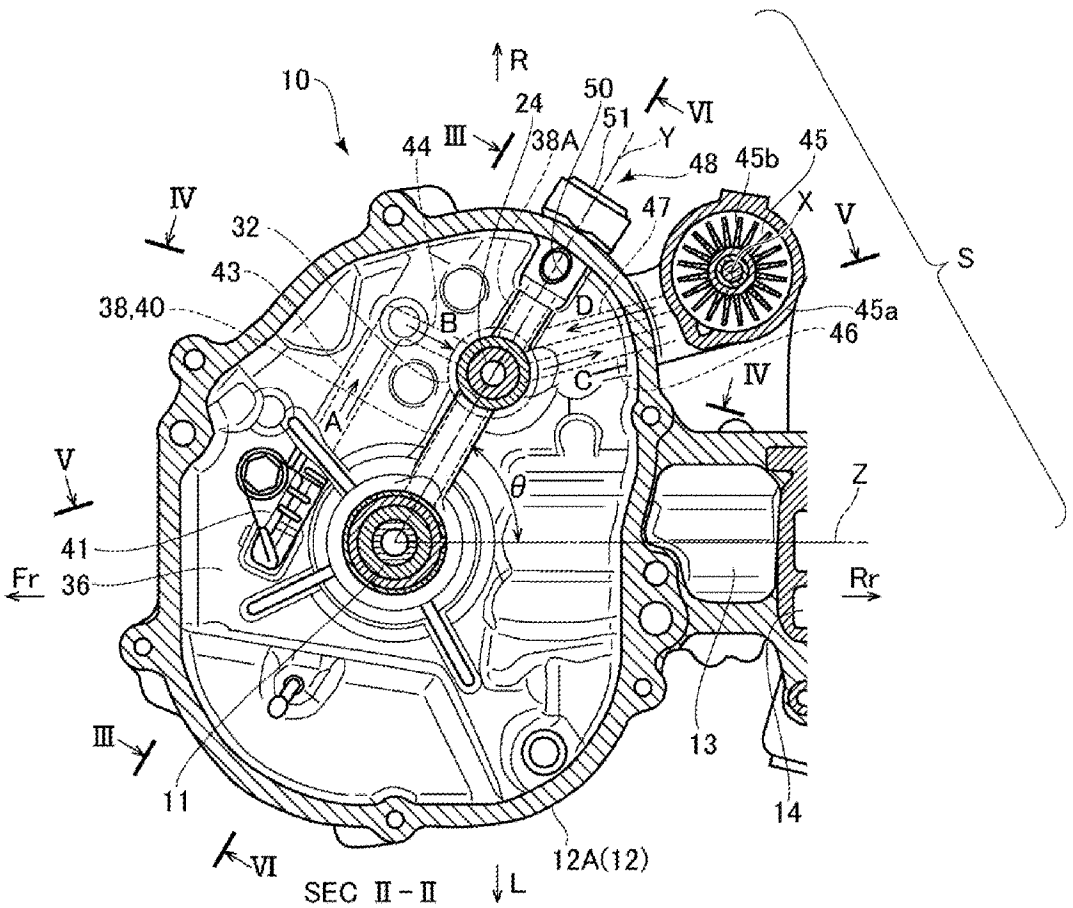
FIG. 6 is a cross-sectional view taken along a line II-II in FIG. 3.

As illustrated in FIG. 6, the camshaft 24 is arranged on the right obliquely rearward of the crankshaft 11 near the crankshaft 11 with a predetermined distance to the crankshaft 11. That is, the camshaft 24 is arranged biased to the cylinder head 14 side with respect to the crankshaft 11. Here, with reference to FIG. 8, in the supporting structure of the camshaft 24, the camshaft 24 is rotatably supported by bearings 31A and 31B, which are disposed in the upper engine case 12A and the lower engine case 12B respectively, in the crank chamber 18. The respective bearing 16A and bearing 31A of the crankshaft 11 and camshaft 24 in the upper engine case 12A side are configured on an approximately identical height position, and similarly, the respective bearing 16B and bearing 31B of the crankshaft 11 and camshaft 24 in the lower engine case 12B side are configured on an approximately identical height position.

Figure 8:
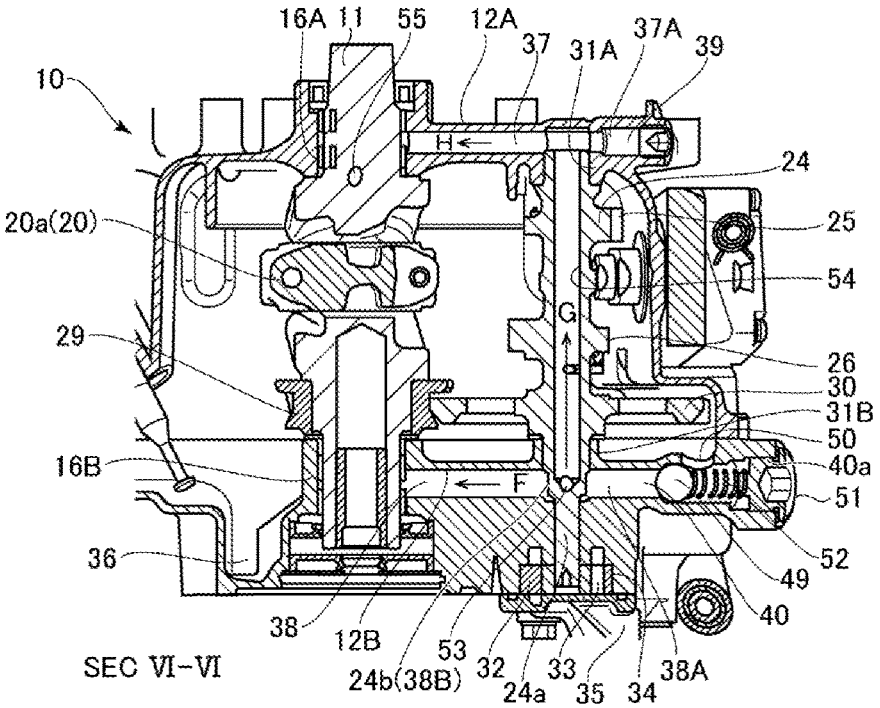
FIG. 8 is a cross-sectional view taken along a line VI-VI in FIG. 6.

The engine 10 includes a lubricating device that lubricates such as around the crankshaft 11 including the bearings 16A and 16B, and around the camshaft 24 including the bearings 31A and 31B. The lubricating device in the embodiment includes an oil pump 32 (see FIG. 5) that uses the crankshaft 11, directly, the camshaft 24 as a driving source to operate. As the oil pump 32, for example, a trochoid pump is employed. In this example, the oil pump 32 is coupled to be mounted on a lower end portion 24*a* of the camshaft 24 (see FIG. 8). In this case, as illustrated in FIG. 8, the lower end portion 24*a* of the camshaft 24 extends to a lower part of the bearing 31B, and a rotor (inner rotor) 33 of the oil pump 32 is pivotably supported to the lower end portion 24*a*. A part of the lower engine case 12B constitutes a casing 34 where the rotor (inner rotor and outer rotor) 33 is rotatably housed, and the rotation of the camshaft 24 drives the oil pump 32. The casing 34 is deposited by a pump cover 35. The engine 10 includes a lubricating oil passage that supplies the lubricating oil on an appropriate position, and the lubricating oil is supplied to the units of the engine 10 that requires to be lubricated passing through the lubricating oil passage by the oil pump 32 constituting the lubricating device.

Next, a description will be given of a specific exemplary configuration of the lubricating system. As illustrated in such as FIG. 6 and FIG. 9, the lower engine case 12B is configured as also an oil reservoir 36 downwardly dented to reserve a certain amount (depth) of the lubricating oil. With reference to FIG. 8, the lubricating oil passage of the lubricating system includes communication portions 37 and 38 that causes the bearings 16A and 16B of the crankshaft 11 to be communicated with the bearings 31A and 31B of the camshaft 24 respectively from outside the upper engine case 12A and the lower engine case 12B. In this case, the communication portion 37 causes the bearing 16A and the bearing 31A to be communicated one another, and the communication portion 38 causes the bearing 16B and the bearing 31B to be communicated with one another. The lubricating oil passage includes extending portions 37A and 38A extending from outside the upper engine case 12A and the lower engine case 12B toward the bearings 31A and 31B of the camshaft 24 respectively. The communication portion 37 and the extending portion 37A are linearly formed, and the communication portion 38 and the extending portion 38A are linearly formed. These lubricating oil passages constitute main lubricating oil passages 39 and 40.

Figure 7A:
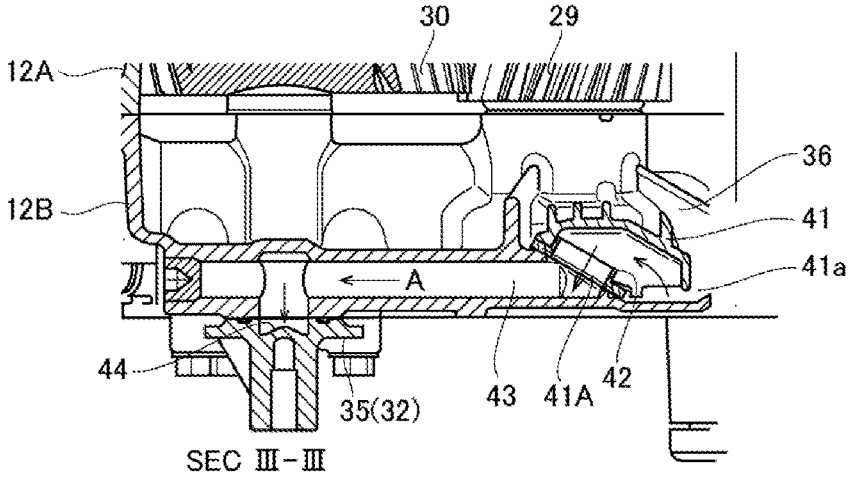
FIG. 7A is a cross-sectional view taken along a line in FIG. 6.
Figure 7B:
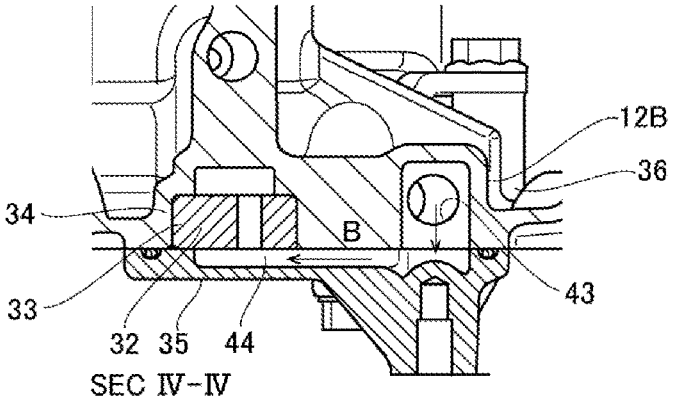
FIG. 7B is a cross-sectional view taken along a line IV-IV in FIG. 6.
Figure 9:
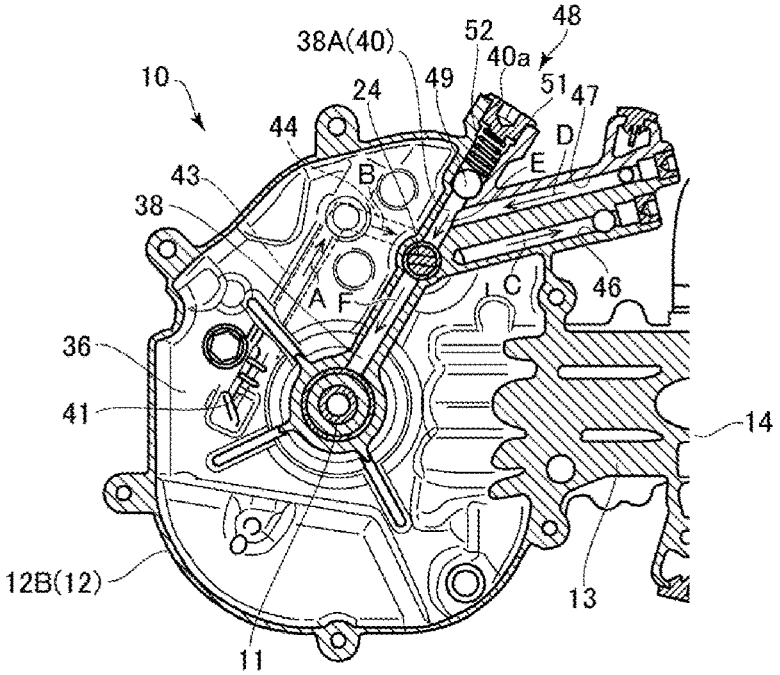
FIG. 9 is a cross-sectional plane view illustrating around a main lubricating oil passage of the engine according to the embodiment of the present invention.

As illustrated in such as FIG. 6 and FIG. 9, the oil reservoir 36 includes a strainer 41 on the bottom surface near the crankshaft 11. As illustrated in FIG. 6 and FIG. 9, the strainer 41 is secured to the lower engine case 12B so as to be arranged on an approximately opposite side to the cylinder block 13 across the crankshaft 11. Then, as illustrated in FIG. 7A, thus secured strainer 41 includes a suction port 41*a* for the lubricating oil between the bottom surface of the lower engine case 12B and the strainer 41. As illustrated in FIG. 7A, a rubber cushion 42 integrally molded with a filtration mesh 41A is mounted between the strainer 41 and the lower engine case 12B. As illustrated in FIG. 7A, the lubricating oil in the oil reservoir 36 is first supplied to the lubricating system via the suction port 41*a* of the strainer 41 by a suctioning force caused by the operation of the oil pump 32. With reference to FIG. 6, the lubricating oil that has passed through the filter of the strainer 41 passes through a lubricating oil passage 43 disposed on the lower engine case 12B as illustrated in FIG. 7A (see an arrow A in FIG. 6 and FIG. 7A) to be further supplied to the oil pump 32 via a lubricating oil passage 44 disposed on the pump cover 35 as illustrated in FIG. 7B (see an arrow B in FIG. 6 and FIG. 7B).

As described above, the camshaft 24 is disposed biased to the cylinder head 14 side with respect to the crankshaft 11, and the oil pump 32 is disposed on the lower engine case 12B corresponding to the lower end portion 24*a* of the camshaft 24. In this case, as illustrated in FIG. 6, the main lubricating oil passages 39 and 40, on which the camshaft 24 is disposed, are disposed inclining to the direction of the cylinder head 14 so as to intersect with the cylinder axis line Z with an acute angle θ. The lubricating oil is pumped from the oil pump 32 to each unit, and the lubricating oil is supplied to the oil filter before pumped to each unit.

Figure 7C:
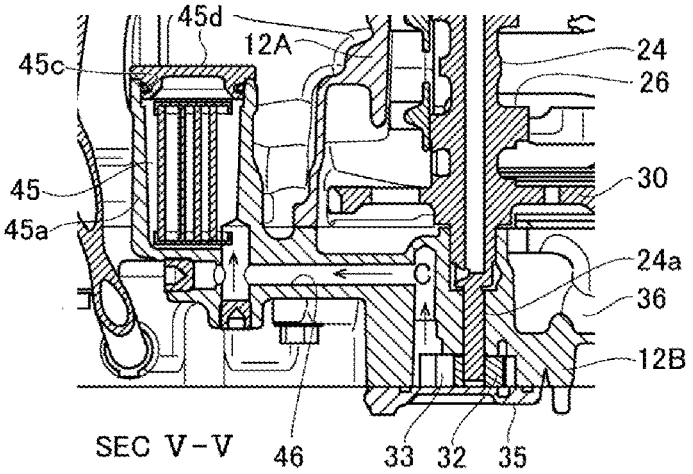
FIG. 7C is a cross-sectional view taken along a line V-V in FIG. 6.

As illustrated in FIG. 6, in a space S between a center line Y of the main lubricating oil passage 39 and the cylinder axis line Z of the cylinder block 13, an oil filter device 45 is disposed on a side portion of one side of the cylinder block 13 in the width direction, in this example, on the right side portion in the width direction, in the cylinder head 14 side with respect to the lower engine case 12B of the engine case 12. As illustrated in FIG. 6, FIG. 7C, and FIG. 9, the oil pump 32 and the oil filter device 45 are communicated with one another via a lubricating oil passage 46, and the lubricating oil discharged by the oil pump 32 is supplied to the oil filter device 45 passing through the lubricating oil passage 46 as indicated by an arrow C in FIG. 6, FIG. 7C, and FIG. 9. As illustrated in FIG. 6 and FIG. 9, the oil filter device 45 and the main lubricating oil passage 40 (extending portion 38A) are communicated with one another via a lubricating oil passage 47, and the lubricating oil cleaned by the oil filter device 45 flows into the extending portion 38A passing through the lubricating oil passage 47 as indicated by an arrow D in FIG. 6 and FIG. 9.

Here, as illustrated in FIG. 5, the oil filter device 45 includes a cylindrically-shaped filter case 45*a* where a cylindrically-shaped filter 45*b* is housed as FIG. 6. As illustrated in FIG. 5, the filter case 45*a* is disposed such that a central axis line X of the cylindrical shape of the filter 45*b* is parallel to an axis line 11A of the crankshaft 11. The oil filter device 45 includes an opening 45*c* configured to mount and remove the filter 45*b* (see FIG. 7C) and a lid body 45*d* that covers the opening 45*c*.

The intake device 23 that supplies the engine combustion air is disposed on one side portion (left side in this example) of the cylinder block 13 on the opposite side to the oil filter device 45 across the cylinder axis line Z with reference to FIG. 2.

The lubricating oil flown into the extending portion 38A from the lubricating oil passage 47 (FIG. 9, arrow E) is subsequently pumped to each unit via the main lubricating oil passages 39 and 40. Here, as illustrated in such as FIG. 9, the engine 10 includes a relief device 48 that adjusts the pressure of the lubricating oil. The relief device 48 sets and maintains the pressure of the lubricating oil pumped to each unit to a predetermined pressure. The relief device 48 includes a relief valve 49 and a relief hole 50 (FIG. 6) on the extending portion 38A, and is configured such that the lubricating oil that has passed the relief valve 49 flows out to the oil reservoir 36 via the relief hole 50 when the pressure of the lubricating oil in the extending portion 38A, that is, the main lubricating oil passage 40, rises to equal to or more than the predetermined pressure. The relief valve 49 is formed of a valve element that moves forward and rearward along the axis line of the main lubricating oil passage 40. The relief valve 49 includes a retainer 51 that obstructs an outer opening 40*a* opening to the outside of the lower engine case 12B of the extending portion 38A that constitutes the main lubricating oil passage 40. The extending portion 38A mounts a spring 52 that biases the relief valve 49 in a closing direction. In this case, the increase of the pressure of the lubricating oil in the extending portion 38A to equal to or more than the predetermined pressure moves the relief valve 49 in an opening direction against elasticity of the spring 52. This causes the extending portion 38A to be communicated with the relief hole 50. The relief hole 50 is drilled on the main lubricating oil passage 40 facing upward parallel to the respective bearings 16B and 31B of the crankshaft 11 and the camshaft 24.

The extending portion 38A and the communication portion 38 are communicated with one another by a ring groove-shaped passage 38B disposed between the extending portion 38A and the communication portion 38, and an outer peripheral surface of a stepped portion 24*b* of the camshaft 24 (see FIG. 8). The lubricating oil flown into the extending portion 38A from the lubricating oil passage 47 flows into the communication portion 38 via the ring groove-shaped passage 38B as indicated by an arrow F in FIG. 8 and FIG. 9. The camshaft 24 includes a communication hole 53 communicated with the main lubricating oil passage 40. The extending portion 38A and the communication portion 38 are communicated with one another also via the communication hole 53. The communication hole 53 is communicated with a lubricating oil passage 54 internally disposed on the camshaft 24. The lubricating oil flown in via the communication hole 53 flows inside the lubricating oil passage 54 upward as indicated by an arrow G in FIG. 8.

As illustrated in FIG. 8, the lubricating oil passage 54 is further communicated with the communication portion 37 and the extending portion 37A of the main lubricating oil passage 39. The lubricating oil flown into the communication portion 37 is supplied to the bearing 16A of the upper engine case 12A as indicated by an arrow H in FIG. 8.

Further, as illustrated in FIG. 4 or FIG. 8, the crankshaft 11 internally includes a communication hole 55 that causes a corresponding portion of the bearing 16A of the upper engine case 12A and the crank pin 11*a* to be communicated with one another. Via the communication hole 55, a part of the lubricating oil supplied to the bearing 16A is supplied to an outer peripheral surface of the crank pin 11*a* as indicated by an arrow I in FIG. 4.

In the above configuration, the operation of the engine 10 drives the oil pump 32. This supplies the lubricating oil pumped from the oil reservoir 36 to the oil filter device 45 passing through the lubricating oil passage 46. Then, the lubricating oil cleaned by the oil filter device 45 flows into the extending portion 38A passing through the lubricating oil passage 47. As described above, the lubricating oil is supplied to the bearings 16A and 16B of the crankshaft 11 passing through the main lubricating oil passages 39 and 40 to lubricate the bearings 16A and 16B of the crankshaft 11. Apart of the lubricating oil flown into the extending portion 38A lubricates around the bearings 31A and 31B of the camshaft 24. A part of the lubricating oil supplied to the bearing 16A of the crankshaft 11 lubricates around the crank pin 11*a* via the communication hole 55.

The lubricating oil supplied to the bearings 16A and 16B of the crankshaft 11 and around the crank pin 11*a* is scattered around by the rotation of the crankshaft 11. The scattered lubricating oil ensures lubricating components around such as the valve mechanism including around the piston 19 and the piston pin 21, the intake-side cam 25, the exhaust-side cam 26, the intake-side push rod 27 and the exhaust-side push rod 28, further, the rocker arm, and similar component. Thus the lubricating oil that has lubricated each unit that requires to be lubricated drops to the oil reservoir 36 to be recovered, and the lubricating cycle in the lubricating system is continued again in the same manner as described above. This ensures and maintains the smooth and proper operation of the engine 10.

According to the four-cycle OHV engine of the present invention, especially, the oil filter device 45 is disposed on a side portion of one side of the cylinder block 13 in the width direction in the cylinder head 14 side with respect to the lower engine case 12B in the space S between the center line Y of the main lubricating oil passage 39 and the cylinder axis line Z of the cylinder block 13. The oil pump 32 and the oil filter device 45 are communicated with one another via the lubricating oil passage 46, and at the same time, the oil filter device 45 and the main lubricating oil passage 40 are communicated with one another via the lubricating oil passage 47.

Thus disposing the oil filter device 45 on the side portion of one side of the cylinder block 13 in the width direction in the cylinder head 14 side prevents the engine 10 from projecting in the width direction to ensure compactly forming the engine 10.

The oil pump 32 is disposed on the lower engine case 12B corresponding to the shaft end portion 24*a* of the camshaft 24 disposed biased to the cylinder head 14 side with respect to the crankshaft 11, and the main lubricating oil passages 39 and 40 are disposed inclining to the direction of the cylinder head 14 so as to intersect with the cylinder axis line Z with an acute angle.

Thus efficiently and intensively disposing a plurality of functional components or members relating to one another effectively reduces the length of the lubricating oil passage 46 and the lubricating oil passage 47 that connect the components or members. Then, reducing machining manhour of the components or members reduces the cost required for such as processing.

The oil filter device 45 includes the filter case 45*a* and the filter 45*b* housed in the filter case 45*a*. The filter case 45*a* is disposed such that the central axis line X of the cylindrical shape of the filter 45*b* is parallel to the axis line lib of the crankshaft 11.

As illustrated in FIG. 2 or FIG. 5, loosening a bolt 45*e* to remove the lid body 45*d*, which is secured to the filter case 45*a* with the bolt 45*e*, from the filter case 45*a* ensures easily taking out the filter 45*b* in the direction of the central axis line X. In this case, a sufficient space for taking out the filter 45*b* is ensured upward the filter case 45*a*. Then, the exchanging operation of the filter 45*b* can be performed extremely easily.

The intake device 23 that supplies the engine combustion air is disposed on one side portion of the cylinder block 13 on the opposite side to the oil filter device 45 across the cylinder axis line Z as illustrated in FIG. 2.

Disposing the intake device 23 and the oil filter device 45 in a balanced manner on right and left across the cylinder block 13 ensures compactly forming the length of the outboard motor 100 specifically in the width direction. This improves the operability of the outboard motor 100. Disposing the intake device 23 apart from the oil filter device 45 that has a high temperature depending on the temperature of the lubricating oil ensures maintaining the temperature of the intake air sucked by the intake device 23 to be low. This increases the air intake efficiency of the intake device 23 to improve the output of the engine 10.

While the present invention has been described using various embodiments above, the present invention is not limited only to these embodiments. Changes and similar modification are possible within the scope of the present invention.

For example, the oil filter device 45 and the intake device 23 may be disposed in a positional relationship of left-right reversal.

While the example of the outboard motor is described as the embodiment of the present invention, the present invention is effectively applicable to a case of equipment or a device that mounts a crankshaft located in the vertical direction.

According to the present invention, disposing the oil filter device on the side portion of one side of the cylinder block in the width direction in the cylinder head side prevents the engine from projecting in the width direction to ensure compactly forming the engine.

Efficiently and intensively disposing a plurality of functional components or members relating to one another effectively reduces the length of the lubricating oil passages that connect the components or members. Then, reducing machining man-hour of the components or members reduces the cost required for such as processing.

What is claimed is:

1. A four-cycle overhead valve (OHV) engine comprising:

a crankshaft disposed in a vertical direction;

an engine case housing and supporting the crankshaft; and a camshaft disposed parallel to the crankshaft in the engine case housing and adjacently to the crankshaft, the camshaft including an intake-side cam and an exhaust-side cam, wherein:

a cylinder axis line is perpendicular to the vertical direction, rotation of the camshaft opens and closes an intake valve and an exhaust valve via cam/push rod coupling, the engine case housing includes bearings that rotatably support the crankshaft and the camshaft, an oil pump and lubricating oil passages that pump lubricating oil to the bearings, and an oil filter device that keeps the lubricating oil clean, the lubricating oil passages include main lubricating oil passages, the main lubricating oil passages including communication portions linearly formed with extending portions, the communication portions communicating between the respective bearings of the crankshaft and the camshaft from outside the engine case housing, the extending portions extending from outside the engine case housing to the bearings of the camshaft, the oil filter device is disposed on a side portion of one side of a cylinder body in a width direction in a cylinder head side with respect to the engine case housing in a space between a center line of the main lubricating oil passage and the cylinder axis line of the cylinder body, the oil filter device includes the oil pump disposed on the engine case housing, and the oil filter device further includes lubricating oil passages that connect the oil pump to the main lubricating oil passage, the camshaft is disposed biased to the cylinder head side with respect to the crankshaft, and the oil pump is disposed on a lower engine case of the engine case housing corresponding to a shaft end portion of the camshaft, and the main lubricating oil passages include outer portions inclining to a direction of the cylinder head such that the main lubricating oil passages intersect with the cylinder axis line with an acute angle.

2. The four-cycle OHV engine according to claim 1, wherein the oil filter device includes a cylindrically-shaped filter and a filter case that houses the filter, and the filter case is disposed such that a central axis line of the cylindrical shape of the filter is parallel to an axis line of the crankshaft, and the filter case includes an opening configured to mount and remove the filter and a lid body that covers the opening.

3. The four-cycle OHV engine according to claim 1, wherein the engine has the cylinder axis line configured to be parallel with respect to a travelling direction of an outboard motor that includes the engine, and an intake device that supplies engine combustion air is disposed on one side portion of the cylinder body on an opposite side to the oil filter device across the cylinder axis line.

* * * * *